US010603933B2

(12) United States Patent
Tsuchida

(10) Patent No.: US 10,603,933 B2
(45) Date of Patent: Mar. 31, 2020

(54) ROLL PAPER HOLDER

(71) Applicant: TOSHIBA TEC KABUSHIKI KAISHA, Shinagawa-ku, Tokyo (JP)

(72) Inventor: Kengo Tsuchida, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/196,496

(22) Filed: Nov. 20, 2018

(65) Prior Publication Data

US 2019/0160836 A1 May 30, 2019

(30) Foreign Application Priority Data

Nov. 24, 2017 (JP) ..... 2017-225742

(51) Int. Cl.

| | |
|---|---|
| ***B41J 15/04*** | (2006.01) |
| ***B65H 16/10*** | (2006.01) |
| ***B65H 16/04*** | (2006.01) |
| ***B65H 75/14*** | (2006.01) |
| ***B65H 75/24*** | (2006.01) |
| ***B65H 16/06*** | (2006.01) |

(52) U.S. Cl.

CPC ..... *B41J 15/048* (2013.01); *B41J 15/042* (2013.01); *B65H 16/04* (2013.01); *B65H 16/06* (2013.01); *B65H 16/106* (2013.01); *B65H 75/14* (2013.01); *B65H 75/241* (2013.01); *B65H 2301/41308* (2013.01); *B65H 2301/41342* (2013.01); *B65H 2601/272* (2013.01); *B65H 2801/12* (2013.01)

(58) Field of Classification Search

CPC ..... B41J 15/048; B41J 15/042; B65H 16/04; B65H 75/14; B65H 75/241

See application file for complete search history.

(56) References Cited

U.S. PATENT DOCUMENTS 9,193,557 B2 * 11/2015 Tanaka ..... B65C 9/00
2019/0023037 A1 * 1/2019 Nihashi ..... B41J 15/042

FOREIGN PATENT DOCUMENTS

JP H10-236702 A 9/1998

* cited by examiner

*Primary Examiner* — Lamson D Nguyen
(74) *Attorney, Agent, or Firm* — Foley & Lardner LLP

(57) ABSTRACT

A roll paper holder is provided which rotatably holds belt-like paper to be conveyed towards a printing section when a roll of paper is obtained by winding the paper on an upstream side in a conveyance direction with respect to the printing section. The roll paper holder includes a side wall section in contact with both side ends of the roll of paper in a width direction to prevent the roll of paper from moving in the width direction. The holder further includes at least one protrusion located outside a range where it can contact with the side end of the roll paper to be held having the largest diameter in the side wall section. The at least one protrusion is configured to protrude by a predetermined dimension from a portion contacting with the side end to control a position of the paper in the width direction.

20 Claims, 10 Drawing Sheets

ROLL PAPER HOLDER

CROSS-REFERENCE TO RELATED APPLICATION

This application is based upon and claims the benefit of priority from Japanese Patent Application No. P2017-225742, filed Nov. 24, 2017, the entire contents of which are incorporated herein by reference.

FIELD

Embodiments described herein relate generally to a roll paper holder.

BACKGROUND

Conventionally, there are various types of roll paper holders for rotatably holding a roll paper (that is, a roll of paper, as may also be referred to as rolled paper). As a roll paper holder having a member for pressing a side end of the roll paper, there is a roll paper holder which elastically presses the side end of the roll paper, and a roll paper holder which matches an interval between a pair of side walls with a width of the roll paper.

In a conventional printer that performs printing on the roll paper obtained by winding the paper, a paper guide that guides the paper to determine the position in the width direction of the paper is provided between the roll paper holder and a printing section.

DETAILED DESCRIPTION

In a case where the former type of the above-described roll paper holders is provided, i.e., a roll paper holder that elastically presses the side end of the roll paper, since the roll paper holder presses the side end of the roll paper, paper dust tends to be generated as the roll paper is strongly rubbed. Thus, to help avoid paper dust, the latter type of roll paper holder having a pair of side walls is adopted.

The side end of the roll paper obtained by winding a belt-like paper is uneven due to deviation in a width direction of the overlapping papers. In the roll paper holder having the pair of side walls, the side walls are positioned in contact with the side ends of the roll paper, but the interval between the pair of side walls is wider than the width of the paper by an amount corresponding to the unevenness. Therefore, due to the side wall, a position in the width direction of the paper drawn out from the roll paper is not regulated, and there is a possibility that the paper skews.

In accordance with at least one embodiment, a roll paper holder, which rotatably holds a belt-like paper to be conveyed towards a printing section in a state of a roll paper obtained by winding the paper on the upstream side in a conveyance direction with respect to the printing section, comprises a side wall section in contact with both side ends of the roll paper in a width direction to prevent the roll paper from moving in the width direction; and a protrusion, located outside a range where it can contact with the side end of the roll paper to be held having the largest diameter in the side wall section, configured to protrude by a predetermined dimension from a portion contacting with the side end to determine a position of the paper in the width direction.

First Embodiment

Figure 1:
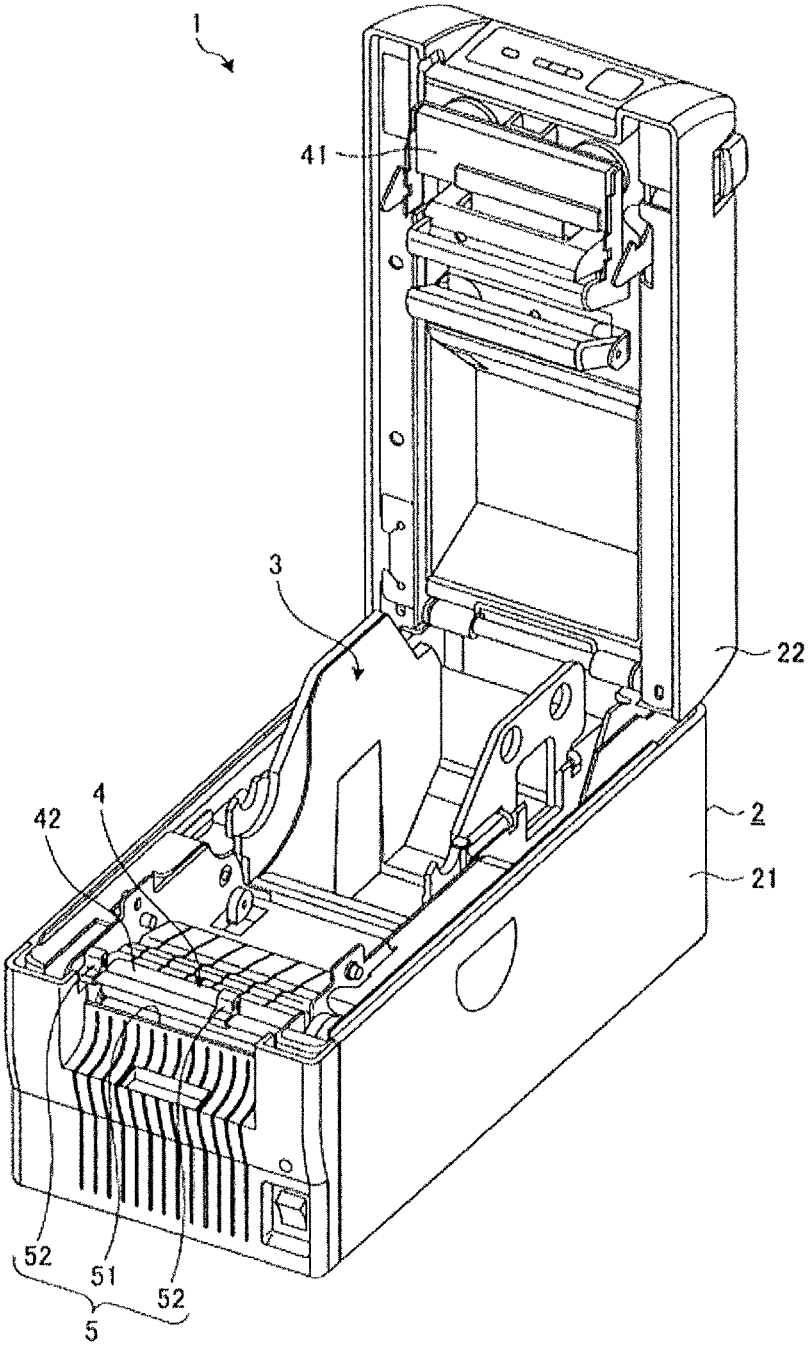
FIG. 1 is a perspective view illustrating an external appearance and an internal structure of a printer according to a first embodiment.

Embodiments are described below with reference to the accompanying drawings. FIG. 1 is a perspective view illustrating an external appearance and an internal structure of a printer 1. The printer 1 stores a roll paper (i.e. a roll of paper) obtained by winding a belt-like paper, and performs printing on the paper drawn out from the roll paper. The roll paper maybe a label roll or a receipt roll. The paper in the label roll is formed by affixing a label of a predetermined dimension to a belt-like mount. The label has an adhesive layer on a surface opposite to a printing surface.

The printer 1 (a printing apparatus) includes a housing 2, a paper housing section 3, a printing section (printer part) 4 and a paper discharge section 5. The paper housing section 3, the printing section 4 and the paper discharge section 5 are built in the housing 2.

The housing 2 includes a main body 21 and a cover 22. The main body 21 is a box with an upper surface thereof opened. The cover 22 is rotatably connected to the main body 21 at one ends thereof, and opens and closes an opening of the main body 21 as the cover 22 rotates. Here, the one end is referred to as a rotation side end, and the other end (an end opposite to the rotation side end) is referred to as an open side end.

The printing section 4 includes a printing head 41 and a platen roller 42, and performs printing on a paper. The printing head 41 is, for example, a line thermal head having a plurality of heating elements, and heats a thermal paper to enable thermal paper to develop colors to perform printing. The platen roller 42 rotates while pressing the paper against the printing head 41 to convey the paper.

The paper discharge section 5 includes a paper discharge port 51 and an exit guide 52. The paper discharge port 51 is an opening through which the paper is discharged from the housing 2, and is provided between the open side ends of the main body 21 and the cover 22. The exit guide 52 is an example of a second guide, and regulates the position of the paper in the width direction between the printing section 4 and the paper discharge port 51.

Figure 2:
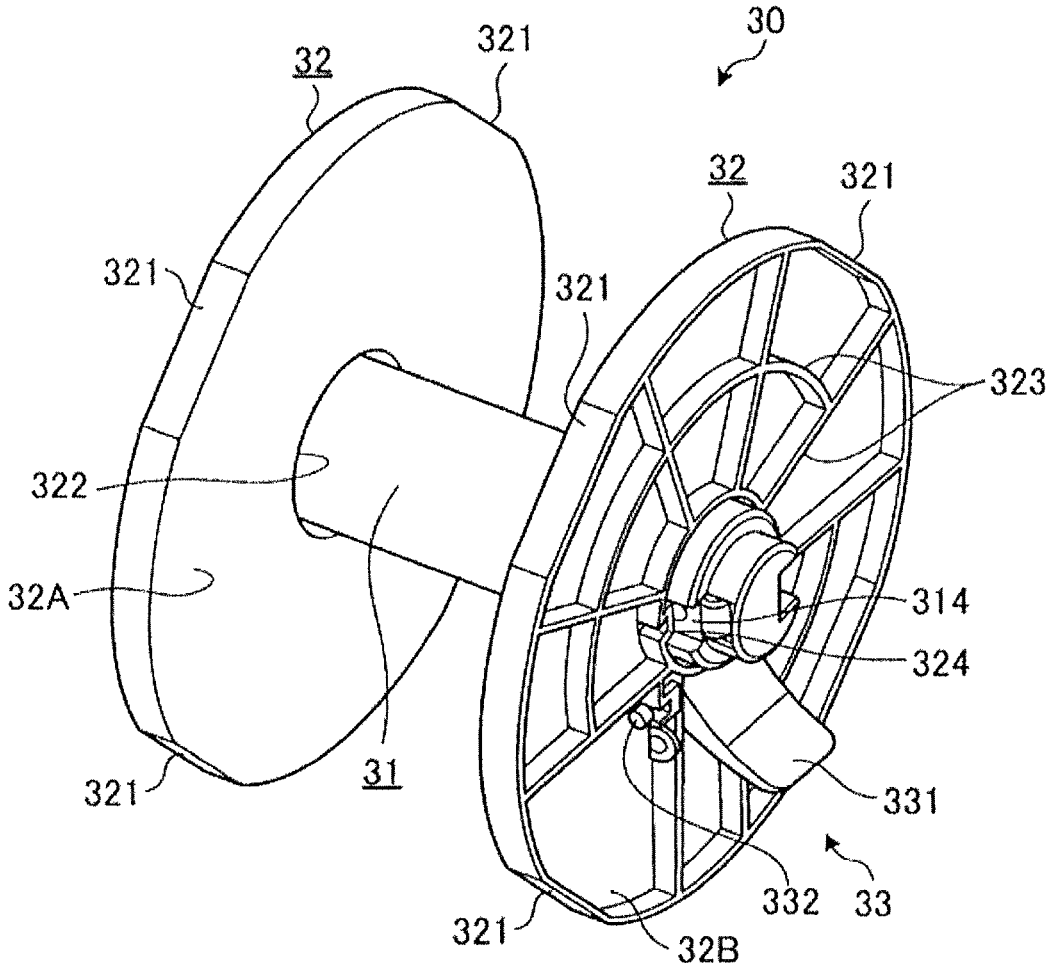
FIG. 2 is a perspective view illustrating an external appearance of a roll paper holder.

FIG. 2 is a perspective view illustrating an external appearance of a roll paper holder 30. The paper housing section 3 accommodates the roll paper holder 30 that rotatably holds the roll paper obtained by winding the belt-like paper. The roll paper is held by the roll paper holder 30, and in this way, the paper is freely drawn out. The roll paper rotates as the paper is drawn out.

The roll paper holder 30 includes a shaft 31, a pair of side plates 32 and a lock section 33. The side plate 32 and the lock section 33 represent an example of a side wall section which contacts the side ends of the roll paper in the width direction to prevent the movement of the roll paper in the width direction.

The shaft 31 passes through a hollow portion of a winding center (winding core) of the roll paper. The pair of side plates 32 sandwiches the roll paper of which the hollow portion is passed through by the shaft 31, and contacts the side ends of the roll paper, respectively. Here, a surface of the side plate 32 in contact with the roll paper is defined as an inner surface 32A, and a reverse surface is referred as an outer surface 32B.

Figure 3:
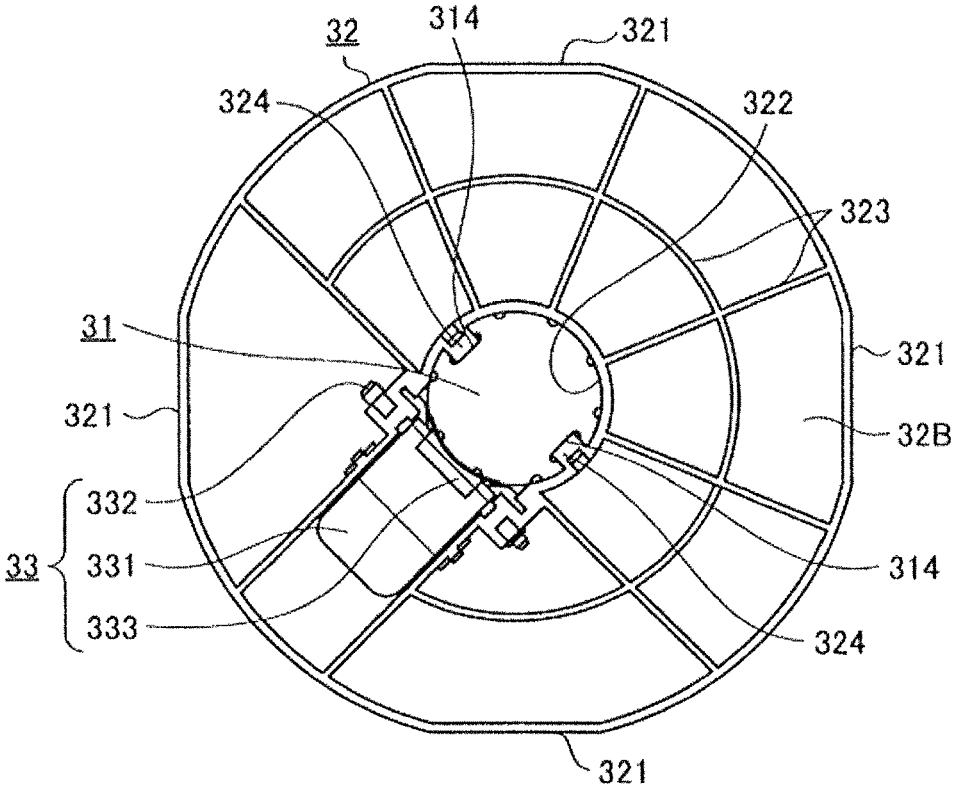
FIG. 3 is a side view of a side plate as viewed from an outer surface thereof.
Figure 4:
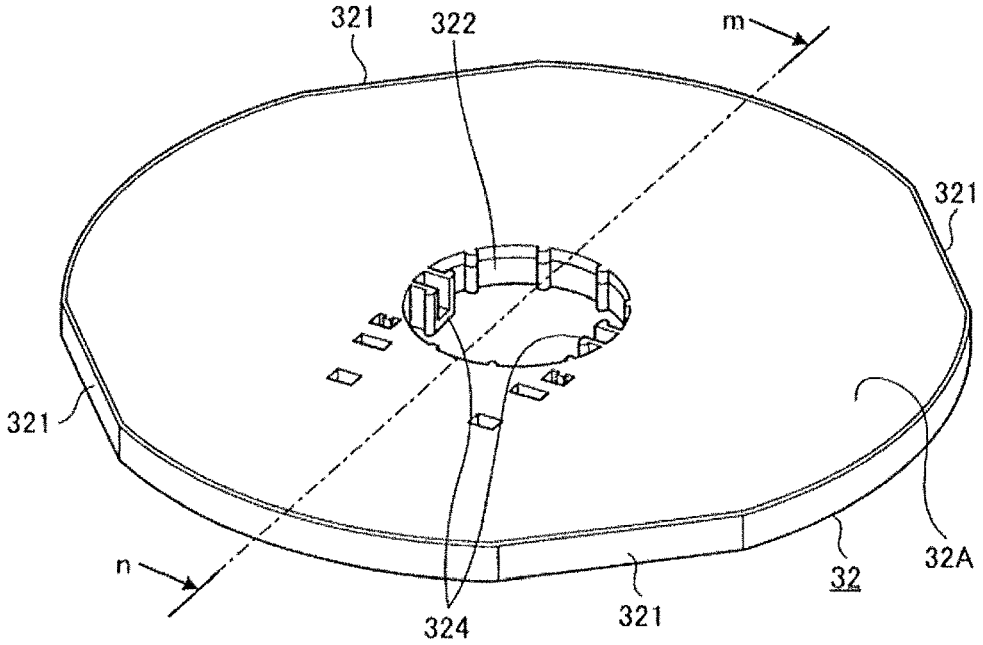
FIG. 4 is a perspective view of the side plate as viewed from an inner surface thereof.

FIG. 3 is a side view of the side plate 32 as viewed from the outer surface 32B. FIG. 4 is a perspective view of the side plate 32 as viewed from the inner surface 32A. The side plate 32 has a roughly disc shape, and includes a planar portion 321, a hole 322, a rib 323 and a protrusion 324.

On an outer periphery of each side plate 32, a plurality of (four in FIG. 4) planar portions 321 is provided. The planar portion 321 is arranged to prevent the roll paper holder 30 from rolling when the roll paper holder 30 composed of the shaft 31 and the pair of side plates 32 is placed on a table with the shaft 31 being horizontal.

The hole 322 is provided in a central portion of the side plate 32, and the shaft 31 passes through the hole 322. The rib 323 is provided to increase a strength of the side plate 32 and to prevent the side plate 32 from bending.

The lock section 33 determines the position of the side plate 32 with respect to the shaft 31 passing through the hole 322. The lock section 33 includes a lever 331, a pivot axis 332 and an elastic member 333.

One end of the lever 331 is rotatably attached to a position near the hole 322 of the side plate 32 by the pivot axis 332. The elastic member 333 is provided at one end of the lever 331, and the position thereof is switched between a position protruding towards the hole 322 side and a position not protruding towards the hole 322 side as the lever 331 pivots. The elastic member 333 is pressed against the shaft 31 in a state of protruding towards the hole 322 side. In this way, the position of the side plate 32 with respect to the shaft 31 is determined.

On an outer peripheral surface of the shaft 31, a pair of grooves 314 along a longitudinal direction of the shaft 31 is formed. The protrusion 324 is provided corresponding to the groove 314. The groove 314 and the protrusion 324 interfere with each other, thereby functioning as a rotation stopper between the shaft 31 and the side plate 32.

Figure 5:
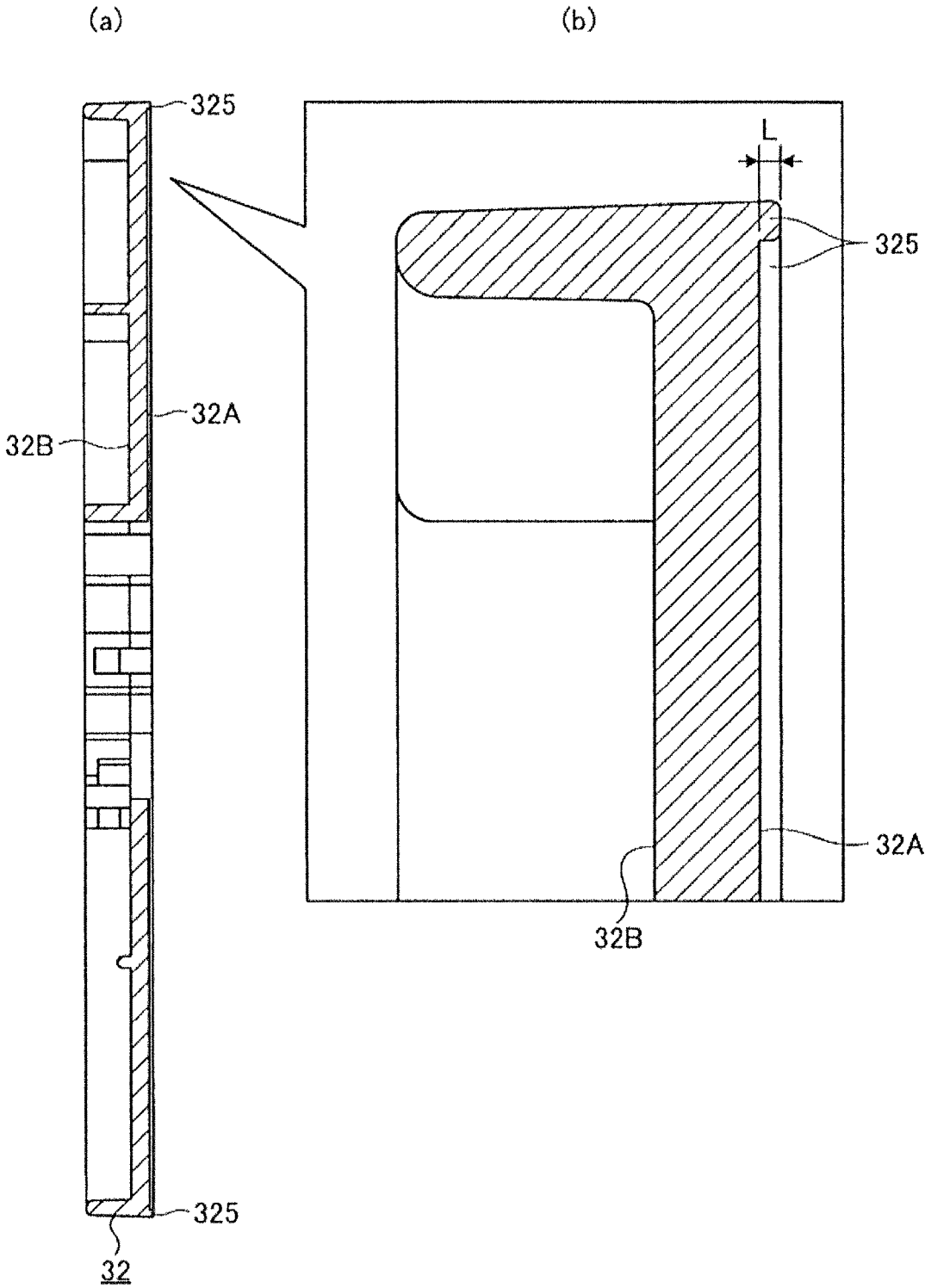
FIG. 5(*a*) is a cross-sectional view of the side plate, and FIG. 5(*b*) is a partially enlarged cross-sectional view of FIG. 5(*a*)

FIG. 5(*a*) is a cross-sectional view of the side plate 32 taken along a line m-n in FIG. 4, and FIG. 5(*b*) is a partially enlarged cross-sectional view of FIG. 5(*a*). The side plate 32 is provided with a guide protrusion 325 at a position close to the outer periphery of the inner surface 32A. The guide protrusion 325 is a first guide and is an example of a protrusion.

The guide protrusion 325 is provided at such a position that the guide protrusion 325 does not contact the outer peripheral surface of the roll paper having the maximum diameter that can be used by the printer 1. That is, the protrusion is shaped so as to surround an outer surface of the side end of the roll of paper having a largest diameter to be accommodated in the holder.

The guide protrusion 325 of at least one embodiment is provided along an edge of the side plate 32. The guide protrusion 325 of at least one embodiment is substantially circular.

In FIG. 5 (*b*), a reference numeral L indicates a protrusion amount of the guide protrusion 325. The protrusion amount L is, for example, about 2 mm. The value is considered as a difference between the width of the roll paper whose side end is uneven and a specified value of the widths of the roll paper and the paper.

Since the printer 1 according to at least one embodiment determines a printing position according to centering, i.e., with the center of the roll paper in the width direction as a reference, the protrusion amount L is required for the unevenness at both side ends of the roll paper.

Figure 6:
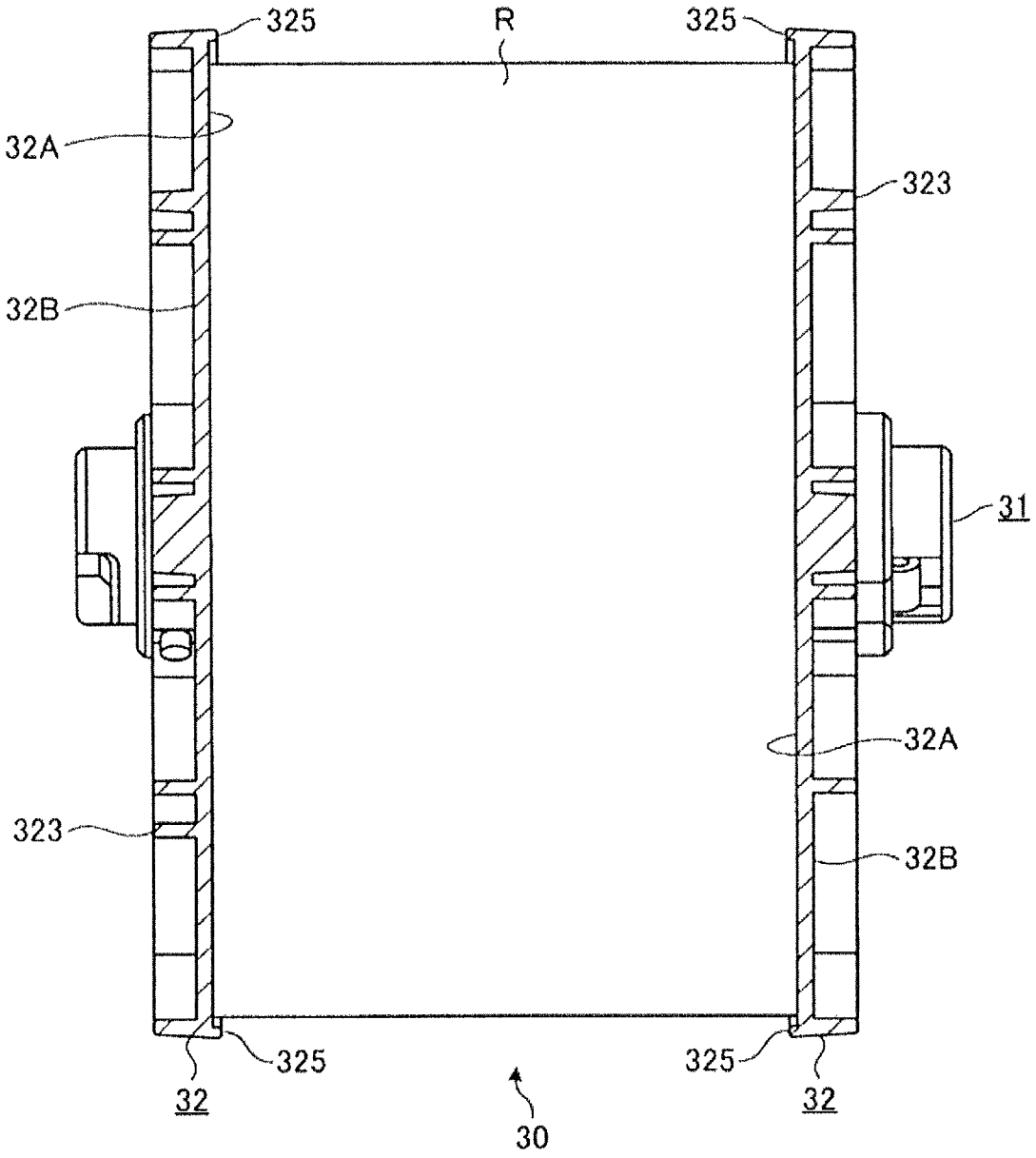
FIG. 6 is a cross-sectional view of a part of the roll paper holder in which roll paper is set.
Figure 7:
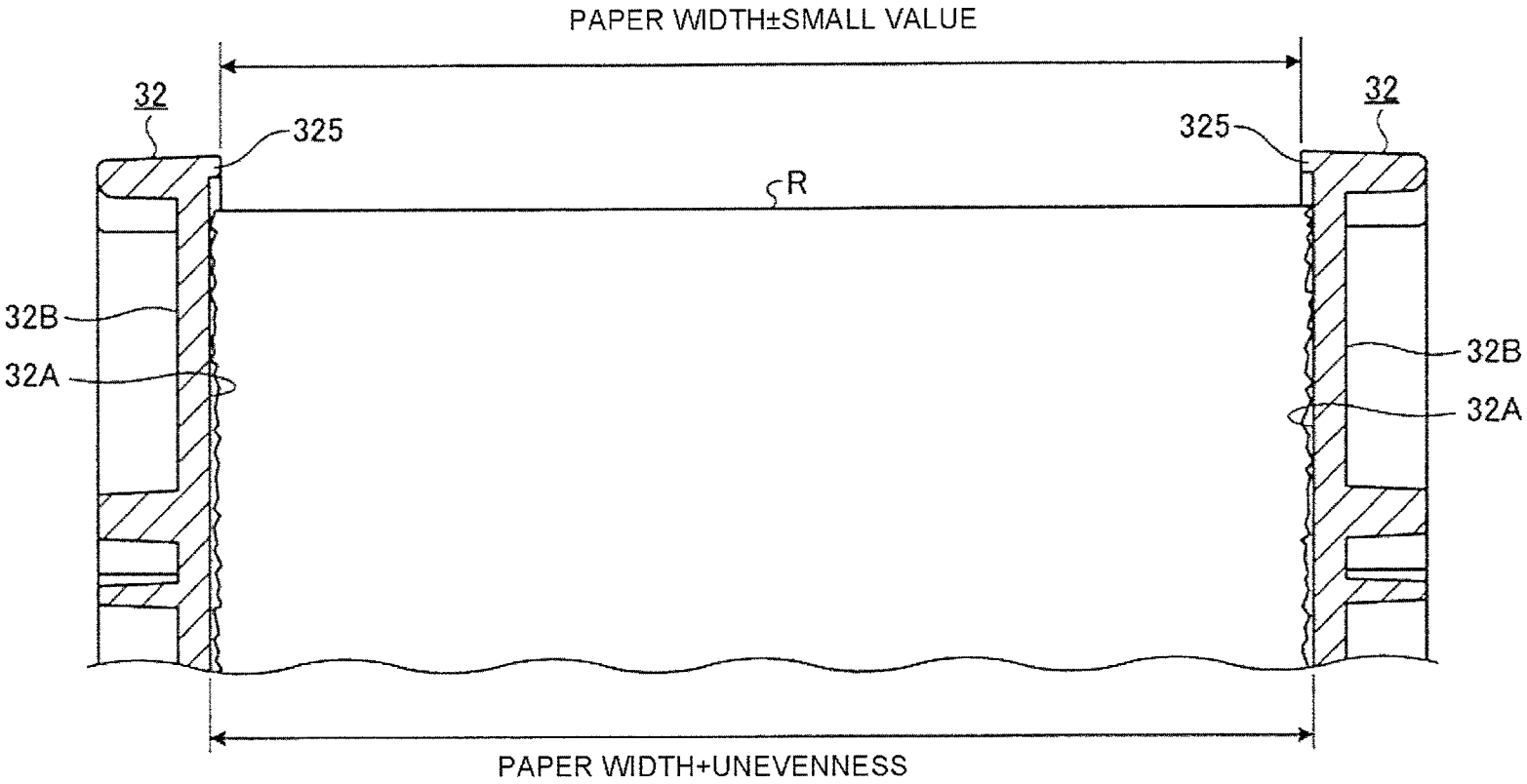
FIG. 7 is a diagram illustrating a relationship between unevenness on a side end of the roll paper and a guide protrusion.

FIG. 6 is a cross-sectional view of a part of the roll paper holder 30 in which a roll paper R is set. FIG. 7 is a diagram illustrating a relationship between the unevenness on the side end of the roll paper R and the guide protrusion 325. Since the protrusion amount L of the guide protrusion 325 is set as described above, an interval between the guide protrusions 325, which are respectively provided on the pair of side plates 32 sandwiching the roll paper R and face each other, is roughly equal to the specified value of the paper width, i.e., is equal to a specified value of the paper width±a small value (e.g., a tolerance).

The paper drawn out from the roll paper R passes between the pair of guide protrusions 325 to be conveyed to the printing section 4. Since the interval between the guide protrusions 325 is roughly equal to the paper width (specified value), the paper is conveyed from the roll paper holder 30 with the position in the width direction thereof determined by the guide protrusions 325.

In the printer 1 having such a configuration, the roll paper R is held by the roll paper holder 30 and accommodated in the paper housing section 3. A part of the inner surface 32A of the side plate 32 where no guide protrusion 325 is arranged contacts the side end of the roll paper R. The position in the width direction of the paper drawn out from the roll paper R is determined by the guide protrusion 325. The paper drawn out from the paper housing section 3 passes through the printing section 4 and reaches the paper discharge section 5. In the paper discharge section 5, the position of the paper in the width direction is determined by the exit guide 52. Then, the paper is discharged from the paper discharge port 51 to the outside of the housing 2.

In this way, in at least one embodiment, the position in the width direction of the paper drawn out from the roll paper R is determined by two guides, i.e., the guide protrusion 325 of the roll paper holder 30 and the exit guide 52 of the paper discharge section 5. The position of the paper in the width direction is determined on the upstream side and the downstream side of the printing section 4.

As described above, according to the first embodiment, since the position in the width direction of the paper drawn out from the paper housing section 3 is determined by the guide protrusion 325, there is no need to separately provide a paper guide for determining the position in the width direction of the paper between the paper housing section 3 and the printing section 4 as in the conventional art, and thus the number of components is reduced, thereby reducing cost. Since it is not necessary to provide the paper guide separately, a space required in the housing 2 can be reduced, thereby miniaturizing the printer 1.

It is difficult to wind the paper in an exactly overlapped manner when the belt-like paper is wound into the roll paper. For this reason, the paper is slightly shifted in the width direction while being wound. Thus, the side end of the roll paper is uneven. The interval between the pair of side plates in contact with the side ends of the roll paper is wider than the width of the paper in the past. Therefore, in the conventional printer, it is necessary to provide a member (paper guide) for determining the position of the paper in the width direction in front of the printing section in addition to the vicinity of the paper discharge port, or to press the side plate against the roll paper using a spring material or the like.

Compared with the configuration of the conventional printer as described above, according to at least one embodiment, since the roll paper holder 30 is provided with a substitute of the paper guide (guide protrusion 325) in front of the printing section, it is possible to reduce the number of components, thereby reducing the cost and miniaturizing the printer 1.

In the roll paper holder in which the side plate is pressed against the roll paper by the spring material or the like, a frictional force between the end of the roll paper and the side plate is large, and thus paper dust is easily generated, which requires labor and time for maintenance. However, according to at least one embodiment, such labor and time can be saved.

In at least one embodiment, the guide protrusion 325 is substantially circular, but it may not be circular in certain implementations.

First and Second Modifications

Figure 8:
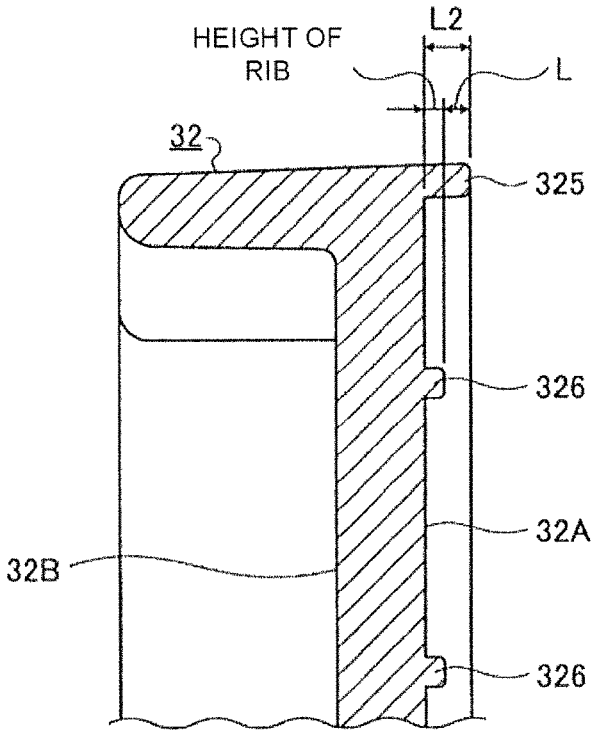
FIG. 8 is a cross-sectional view of a side plate having a rib on the inner surface thereof according to a first modification of the first embodiment.
Figure 9:
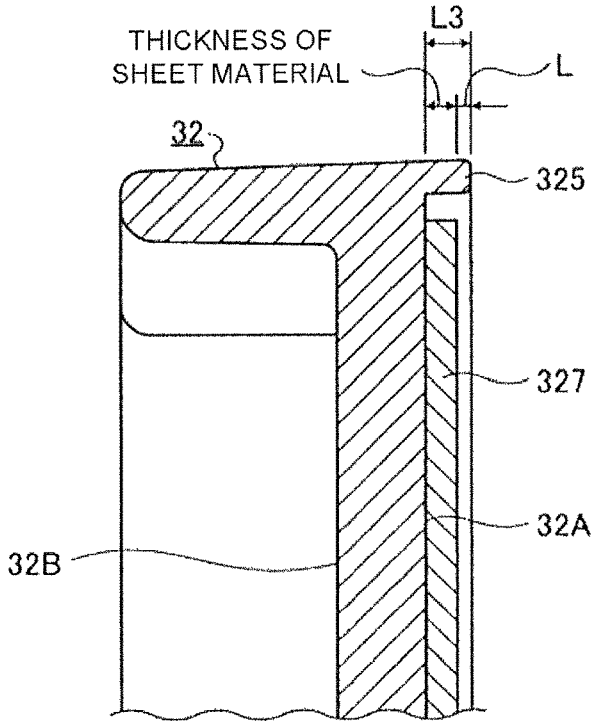
FIG. 9 is a cross-sectional view of a side plate having a sheet material on the inner surface thereof according to a second modification of the first embodiment.

Next, first and second modifications of the first embodiment are described. FIG. 8 is a cross-sectional view of the side plate 32 provided with a rib 326 on the inner surface 32A thereof according to the first modification. FIG. 9 is a cross-sectional view of the side plate 32 provided with a sheet material 327 on the inner surface 32A according to the second modification.

The rib 326 reduces a contact area between the inner surface 32A and the side end of the roll paper to reduce the friction therebetween. The sheet material 327 is made of, for example, a fluororesin, and reduces the friction between the inner surface 32A and the side end of the roll paper.

As described above, in a case in which the rib 326 and the sheet material 327 are provided on the inner surface 32A, a protrusion amount of the guide protrusion 325 is as shown in FIG. 8 and FIG. 9.

When there is the rib 326 on the inner surface 32A, a protrusion amount L2 of the guide protrusion 325 from the top of the rib 326 to the top of the guide protrusion 325 is set to be equal to the protrusion amount L in the first embodiment. In other words, a protrusion amount of the guide protrusion 325 from a portion of the inner surface 32A where there is no rib 326 is larger than that of the guide protrusion 325 in the first embodiment by a difference corresponding to a height of the rib 326.

Similarly, when there is the sheet material 327 on the inner surface 32A, a protrusion amount L3 of the guide protrusion 325 from a surface of the sheet material 327 to the top of the guide protrusion 325 is set to be equal to the protrusion amount L in the first embodiment. In other words, the protrusion amount of the guide protrusion 325 from a portion of the inner surface 32A where there is no sheet material 327 is larger than that of the guide protrusion 325 in the first embodiment by a difference corresponding to a thickness of the sheet material 327.

Second Embodiment

Next, the second embodiment is described with reference to FIG. 10 to FIG. 13. In the description of the second embodiment, the same reference numerals are denoted to the same components as those of the first embodiment, and only the parts different from the first embodiment are described below.

Figure 10:
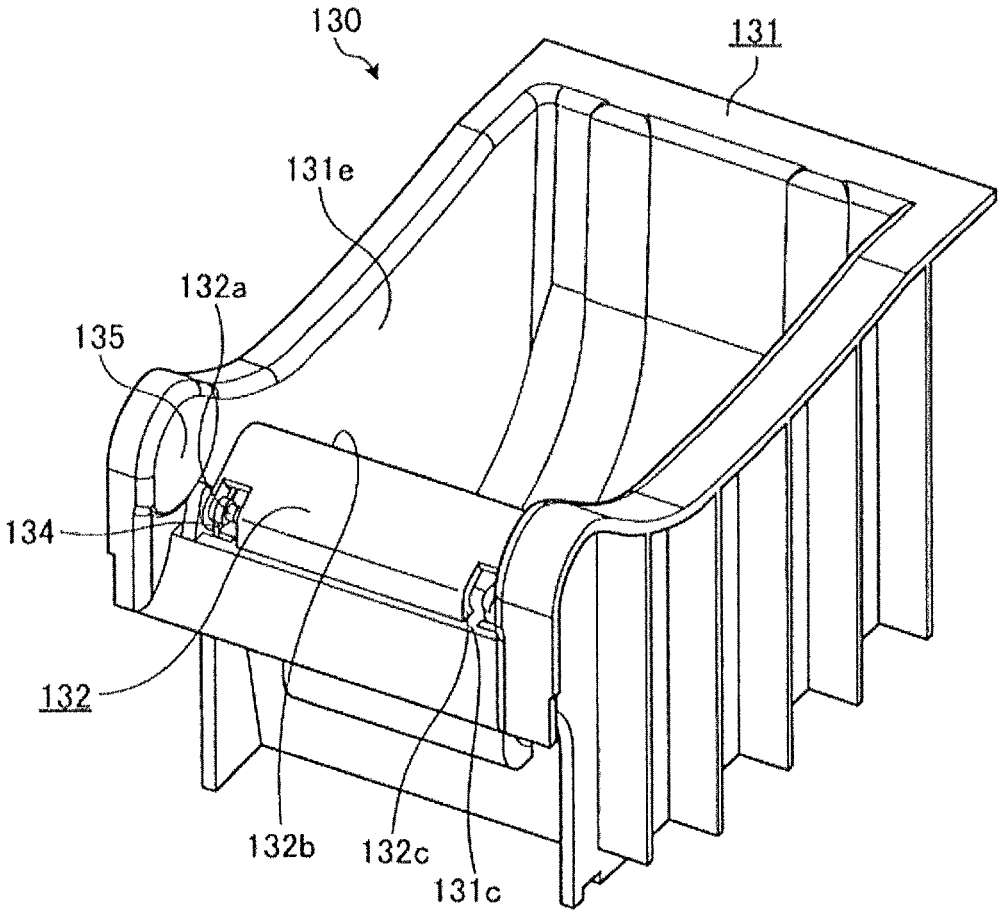
FIG. 10 is a perspective view illustrating an external appearance of a roll paper holder according to a second embodiment.
Figure 11:
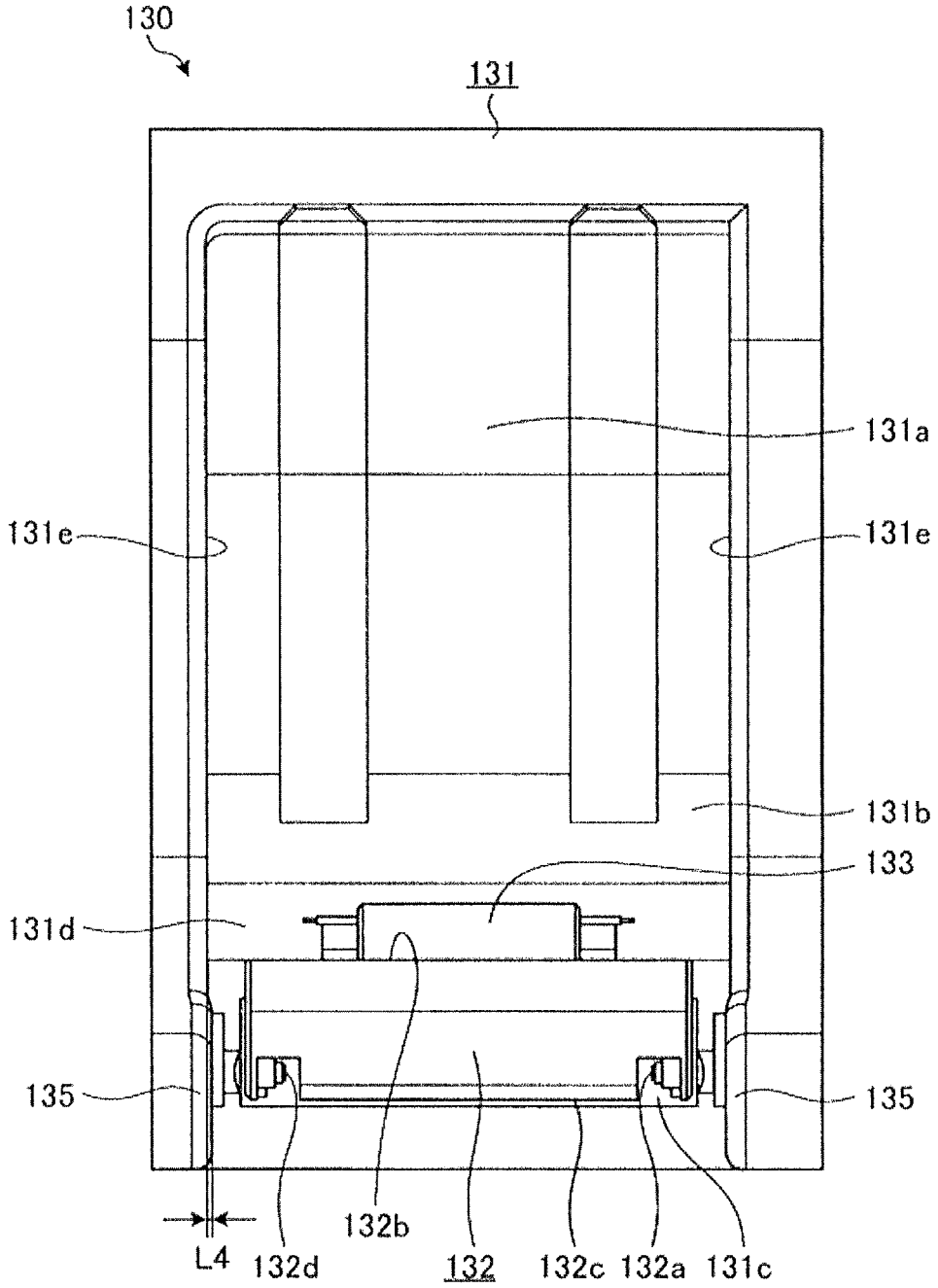
FIG. 11 is a plan view illustrating an external appearance of the roll paper holder.

FIG. 10 is a perspective view illustrating an external appearance of a roll paper holder 130 according to the second embodiment. FIG. 11 is a plan view illustrating the external appearance of the roll paper holder 130. The roll paper holder 130 may be detachably inserted into the paper storage section 3 or may be fixed to the paper storage section 3.

The roll paper holder 130 is a so-called insertion type roll paper holder, and is suitable for a receipt roll rather than a label roll. The roll paper holder 130 comprises a hopper 131 and a return wall 132.

Figure 12:
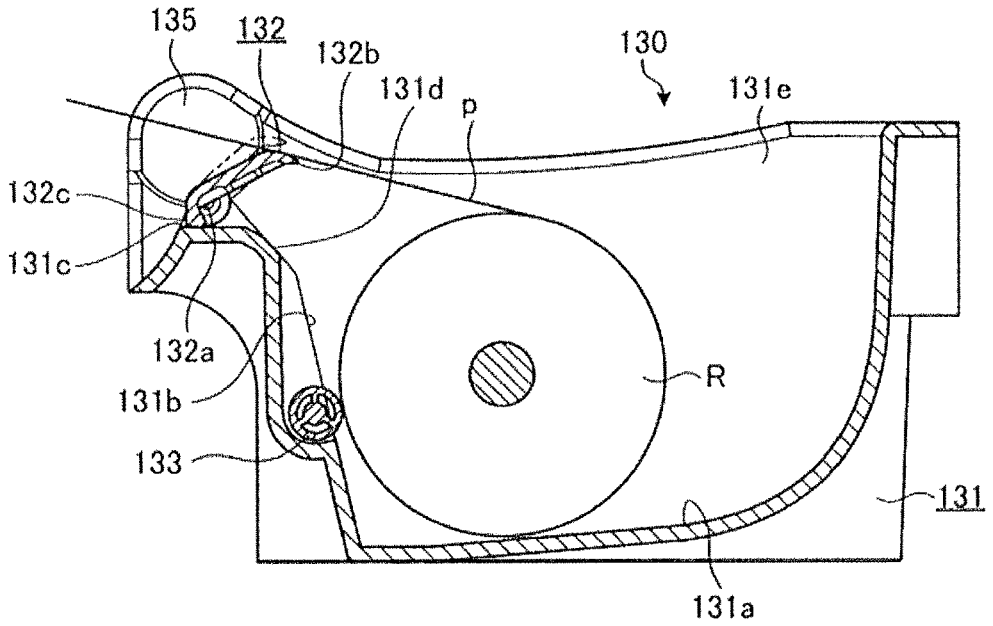
FIG. 12 is a longitudinal sectional side view illustrating a structure of the roll paper holder as viewed from the right side.
Figure 13:
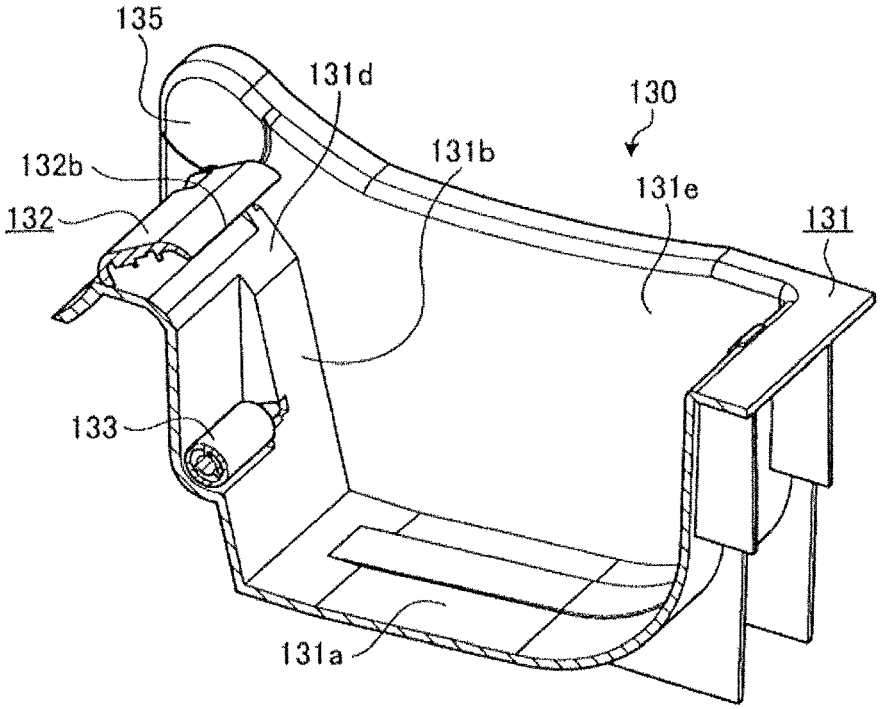
FIG. 13 is a perspective view illustrating the structure of a cross-section of the roll paper holder.

FIG. 12 is a longitudinal sectional side view illustrating a structure of the roll paper holder 130 as viewed from the right side. FIG. 13 is a perspective view illustrating the structure of a cross-section of the roll paper holder 130.

The hopper 131 is a container opening upward and into which the roll paper R is placed. A depth of the hopper 131 is set such that the winding core of the roll paper R at the beginning of use is below the opening.

A bottom surface 131*a* of the hopper 131 is an inclined surface that descends towards the downstream side in a paper conveyance direction. As a result, the roll paper R is close to a front surface 131*b* of the hopper 131, i.e., a surface on the downstream side in the paper conveyance direction. The front surface 131*b* and the bottom surface 131*a* of the hopper 131 form an obtuse angle approximate to the right angle.

The roll paper holder 130 further includes a roller 133 over the front surface 131*b* of the hopper 131. The roller 133 is arranged with a rotation axis thereof along the width direction of the roll paper R, and is rotatable around the rotation axis. Such a roller 133 reduces the frictional force generated between the outer peripheral surface of the roll paper R and the front surface 131*b*.

The return wall 132 is disposed on the downstream side of the hopper 131 in a paper pull-out direction to prevent the roll paper R from jumping out from the hopper 131. The return wall 132 has a substantially rectangular shape, and is attached to the hopper 131 in such a manner that a longitudinal direction thereof extends along the width direction of the roll paper R and it is rotatable around a pivot axis 132*a* along the longitudinal direction thereof. The pivot axis 132*a* is provided at both ends in the longitudinal direction of the return wall 132.

The return wall 132 is in contact with the roll paper R at a long side 132*b* far from the pivot axis 132*a*. The long side 132*b* is positioned on the upstream side in the paper pull-out direction with respect to the pivot axis 132*a*. A length of the long side 132*b*, i.e., a dimension of the return wall 132 in the longitudinal direction is set to be two-thirds or more of the width of the roll paper R in order to press the roll paper R with sufficient stability without rattling.

Here, the return wall 132 further includes an energization member 134 (refer to FIG. 10), and the long side 132*b* is energized by the energization member 134 in a direction towards the outside of the hopper 131. The energization member 134 is, for example, a torsion spring wound around a protrusion concentric with the pivot axis 132*a*, and one end thereof is fixed to the hopper 131 while the other end thereof presses against the inner surface of the return wall 132.

The return wall 132 has a pivot stopper 132*c*. The distance from the pivot axis 132*a* to the outer peripheral surface in the pivot stopper 132*c* is larger than that in other pivot angle positions. The pivot stopper 132*c* interferes with a pivot stopper receiving surface 131*c* formed on the hopper 131 at a predetermined angle, and in this way, a pivot range of the return wall 132 is limited to such a range that the long side 132*b* does not move out of the hopper 131.

The roll paper R shown in FIG. 12 is in a state of being consumed to an extent that it is not lifted from the bottom surface 131*a*. An energization force of the energization member 134 is set to be weak to such a degree that the return wall 132 pivots most against the energization force when the roll paper R (roll paper before consumption) put in the hopper 131 before use contacts the return wall 132. The energization force of the energization member 134 is set to be strong to such an degree that the return wall 132 returns to a position at or close to an angle at which the pivot stopper 132*c* and the pivot stopper receiving surface 131*c* interfere with each other when the roll paper R (roll paper being lifted) lifted from the bottom of the hopper 131 caused by being consumed and becoming lighter hangs under a paper p drawn out from the roll paper R.

The hopper 131 has an inclined surface 131*d* at an upper portion of the front surface 131*b*. The inclined surface 131*d* is provided for stabilizing the movement of the roll paper being lifted between the inclined surface 131*d* and the return wall 132. The inclined surface 131*d* is provided at a position within a predetermined range (a range in which it contacts the roll paper being lifted) below a mounting position of the return wall 132, and is inclined further upward when compared to the other range (a lower portion of the front surface 131*b*).

A dimension of a portion protruding from the inclined surface 131*d* of the return wall 132 (i.e., an amount or extent of protrusion) in a lateral direction is longer than the maximum value of a radius of the roll paper being lifted. Here, the lateral direction is orthogonal to the longitudinal direction. Since the radius of the roll paper being lifted varies depending on various factors, such as the type of paper and core of the roll paper R, the conveyance speed of the paper and the like, the maximum value among the considered values is taken.

When the roll paper R is replenished or replaced in the roll paper holder 130, the roll paper R is inserted into the hopper 131. At this time, even if the roll paper R abuts against the return wall 132, the return wall 132 pivots towards the inside of the hopper 131 and does not prevent the insertion of the roll paper R. If the roll paper R is inserted into the hopper 131 and does not contact the return wall 132, the return wall 132 returns to a position at an angle at which the pivot stopper 132*c* and the pivot stopper receiving surface 131*c* interfere with each other by the energization force of the energization member 134.

The roll paper holder 130 of at least one embodiment is provided with guide protrusions 135. The guide protrusions 135 are provided in a range in which the paper p drawn out from the roll paper R in the hopper 131 and conveyed towards the printing section 4 can pass through. The guide protrusions 135 are substantially circular, and are provided by extending front ends of a pair of side walls 131*e* of the hopper 131 towards the downstream side in the paper conveyance direction. Here, the side wall 131*e* is an example of the side wall section, and the guide protrusion 135 is an example of the protrusion.

An amount (protrusion amount) L4 of protrusion of the guide protrusion 135 from the side wall 131*e* (refer to FIG. 11) is, for example, about 2 mm, which is equal to the protrusion amount L of the first embodiment, and is a value (representative value) considered as a difference between the width of the roll paper R including the unevenness in the side end of the roll paper R and the specified value of the widths of the roll paper R and the paper p.

The position of the paper p in the width direction is determined on the upstream side of the printing section 4 by providing such a guide protrusion 135.

As described above, according to the second embodiment, the same effects as those of the first embodiment can be achieved.

In the above-described first and second embodiments, the roll paper holder in which the center in the width direction of the roll paper is used as a reference for determining the position with respect to the printing section has been described, but some embodiments are not limited thereto. For example, the first and second embodiments may be applied to a roll paper holder of a side-aligned type or one side-based type with one side end of the roll paper as a reference. In this case, by providing the guide protrusion at least on a side wall section that contacts with the side end on the reference side of the roll paper, it is possible to achieve the same effect as in various embodiments.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A roll paper holder configured to rotatably hold a belt-like paper to be conveyed towards a printing section when a roll of paper is obtained by winding the paper on an upstream side in a conveyance direction with respect to the printing section, comprising:

a side wall section in contact with both side ends of the roll of paper in a width direction to prevent the roll of paper from moving in the width direction; and at least one protrusion, located outside a range where the protrusion can contact with one of the side ends of the roll of paper, the at least one protrusion being configured to protrude by a predetermined amount from a portion contacting with the one of the side ends, so as to control a position of the roll of paper in the width direction.

2. The roll paper holder according to claim 1, wherein:

the side wall section includes a pair of plates attached to a shaft which passes through a hollow portion of a winding core of the roll of paper, the pair of plates contacting both side ends of the roll of paper, which control the position of the roll of paper in the width direction, and the at least one protrusion is provided on the side wall section and protrudes from a surface of the side wall section in contact with the one of the side ends of the roll of paper to contact at least one side end of paper drawn out from the roll of paper.

3. The roll paper holder according to claim 2, wherein the at least one protrusion is shaped so as to surround an outer surface of the side end of the roll of paper having a largest diameter to be accommodated in the holder.

4. The roll paper holder according to claim 1, wherein the side wall section includes a pair of plates that contact the side ends of the roll of paper to control the position of the roll of paper in the width direction with respect to the holder, and the at least one protrusion is provided so as to permit paper drawn out from the roll of paper in the holder and conveyed towards the printing section to pass through at a position where the side wall section extends towards a downstream side in the conveyance direction.

5. The roll paper holder according to claim 4, wherein the predetermined amount of protrusion of the at least one protrusion with respect to a portion contacting with the one of the side ends of the roll of paper is set based on a difference between a representative value of a dimension in the width direction of the roll of paper and a specified value of a paper width, wherein the one of the side ends of the roll of paper is uneven.

6. The roll paper holder according to claim 5, wherein the at least one protrusion comprises a plurality of protrusions respectively provided on the pairs of plates.

7. The roll paper holder according to claim 6, wherein an interval between respective protrusions of the plurality of protrusions is approximately equivalent to the specified value of the paper width.

8. A printing apparatus, comprising:

a printer including a paper housing, a printing section and a discharge section; and a roll paper holder accommodated in the paper housing, the roll paper holder being configured to rotatably hold a belt-like paper to be conveyed towards the printing section when a roll of paper is obtained by winding the paper on an upstream side in a conveyance direction with respect to the printing section;

a side wall section of the roll paper holder being arranged to contact with both side ends of the roll of paper in a width direction to prevent the roll of paper from moving in the width direction; and at least one protrusion of the roll paper holder being located outside a range where the protrusion can contact with one of the side ends of the roll of paper, the at least one protrusion being configured to protrude by a predetermined amount from a portion contacting with the one of the side ends, so as to control a position of the roll of paper in the width direction.

9. The printing apparatus according to claim 8, wherein:

the side wall section includes a pair of plates attached to a shaft which passes through a hollow portion of a winding core of the roll of paper, the pair of plates contacting both side ends of the roll of paper, which control the position of the roll of paper in the width direction, and the at least one protrusion is provided on the side wall section and protrudes from a surface of the side wall section in contact with the one of the side ends of the roll of paper to contact at least one side end of paper drawn out from the roll of paper.

10. The printing apparatus according to claim 9, wherein the at least one protrusion is shaped so as to surround an outer surface of the side end of the roll of paper having a largest diameter to be accommodated in the holder.

11. The printing apparatus according to claim 8, wherein the side wall section includes a pair of plates that contact the side ends of the roll of paper to control the position of the roll of paper in the width direction with respect to the paper housing, and the at least one protrusion is provided so as to permit paper drawn out from the roll of paper in the holder and conveyed towards the printing section to pass through at a position where the side wall section extends towards the discharge section in the conveyance direction.

12. The printing apparatus according to claim 11, wherein the predetermined amount of protrusion of the at least one protrusion with respect to a portion contacting with the one of the side ends of the roll of paper is set based on a difference between a representative value of a dimension in the width direction of the roll of paper and a specified value of a paper width, wherein the one of the side ends of the roll of paper is uneven.

13. The printing apparatus according to claim 12, wherein the at least one protrusion comprises a plurality of protrusions respectively provided on the pairs of plates.

14. The printing apparatus according to claim 13, wherein an interval between respective protrusions of the plurality of protrusions is approximately equivalent to the specified value of the paper width.

15. A method of controlling positioning of a roll of paper, comprising:

positioning belt-like paper in a rotatable holder configured to convey the paper towards a printing section, and obtaining a roll of the paper by winding the paper on an upstream side in a conveyance direction with respect to the printing section;

preventing movement of the roll of paper in a width direction by disposing a side wall section in contact with both side ends of the roll of paper in the width direction; and controlling the position of the roll of paper with respect to the width direction by arranging at least one protrusion outside a range where the protrusion can contact with one of the side ends of the roll of paper, the at least one protrusion being configured to protrude by a predetermined amount from a portion of the side wall section contacting with the one of the side ends.

16. The method according to claim 15, wherein controlling the position of the roll of paper further includes positioning the roll of paper between a pair of plates of the side wall section, the pair of plates being attached to a shaft which passes through a hollow portion of a winding core of the roll of paper, the pair of plates contacting both side ends of the roll of paper, and wherein the at least one protrusion is provided on the side wall section and protrudes from a surface of the side wall section in contact with the one of the side ends of the roll of paper to contact at least one side end of paper drawn out from the roll of paper.

17. The method according to claim 16, wherein the at least one protrusion is shaped so as to surround an outer surface of the side end of the roll of paper having a largest diameter to be accommodated in the holder.

18. The method according to claim 15, wherein the side wall section includes a pair of plates that contact the side ends of the roll of paper to control the position of the roll of paper in the width direction with respect to the holder, and the at least one protrusion is provided so as to permit paper drawn out from the roll of paper in the holder and conveyed towards the printing section to pass through at a position where the side wall section extends towards a downstream side in the conveyance direction.

19. The method according to claim 18, wherein the predetermined amount of protrusion of the at least one protrusion with respect to a portion contacting with the one of the side ends of the roll of paper is set based on a difference between a representative value of a dimension in the width direction of the roll of paper and a specified value of a paper width, wherein the one of the side ends of the roll of paper is uneven.

20. The method according to claim 19, wherein the at least one protrusion comprises a plurality of protrusions respectively provided on the pairs of plates.

* * * * *